US010755501B2

(12) United States Patent
Kaye et al.

(10) Patent No.: US 10,755,501 B2
(45) **Date of Patent: *Aug. 25, 2020**

(54) ROLLING CODE BASED PROXIMITY VERIFICATION FOR ENTRY ACCESS

(71) Applicant: OpenPath Security Inc., Marina Del Rey, CA (US)

(72) Inventors: Cameron Kaye, Van Nuys, CA (US); Samy Kamkar, Los Angeles, CA (US); Robert J. Peters, Culver City, CA (US); Alexander A. Kazerani, Santa Monica, CA (US)

(73) Assignee: OpenPath Security Inc., Marina Del Rey, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/145,402

(22) Filed: Sep. 28, 2018

(65) Prior Publication Data

US 2019/0172287 A1 Jun. 6, 2019

Related U.S. Application Data

(63) Continuation of application No. 15/829,709, filed on Dec. 1, 2017, now Pat. No. 10,089,810.

(51) Int. Cl.
*G07C 9/00* (2020.01)

(52) U.S. Cl.
CPC ..... *G07C 9/00309* (2013.01); *G07C 2009/00492* (2013.01); *G07C 2009/00769* (2013.01); *G07C 2209/63* (2013.01)

(58) Field of Classification Search
CPC . G06F 21/30; G06F 21/6218; G06Q 20/4012; G06Q 20/4016; G06Q 30/02; G07C 9/00309; G07C 2009/00253; G07C 2009/00492; G07C 2009/00769; G07C 2209/63; H04L 63/08; H04L 63/083; H04L 63/0853; H04L 63/0884; H04L 63/10;

(Continued)

(56) References Cited

U.S. PATENT DOCUMENTS 5,554,977 A * 9/1996 Jablonski ..... G06Q 20/341 307/10.2
5,563,600 A * 10/1996 Miyake ..... G07C 9/00182 340/5.24

(Continued)

*Primary Examiner* — Stephen R Burgdorf
(74) *Attorney, Agent, or Firm* — Ansari Katiraei LLP; Arman Katiraei; Sadiq Ansari

(57) ABSTRACT

The solution is directed to access control systems and verifying proximity of a user to an access point that the user is wirelessly requesting access to. The proximity verification is based on placing proximity hubs adjacent to the different access points. Each proximity hub advertises a different unique identifier that changes periodically over a short-range wireless network and can be detected with a mobile device if the mobile device is physically within a short distance from the proximity hub. The unique identifier changes based on a rolling code. A user is permitted access to a restricted access point in response to the mobile device sending over a different long-range wireless network, the unique identifier advertised from a proximity hub adjacent to a desired access point and user access credentials authenticating access privileges of the user to the desired access point.

16 Claims, 5 Drawing Sheets

(58) Field of Classification Search
CPC ..... H04W 4/001; H04W 4/80; H04W 12/06; H04W 12/08
USPC ..... 340/5.26
See application file for complete search history.

(56) References Cited

U.S. PATENT DOCUMENTS 5,594,429 A * 1/1997 Nakahara ..... B60R 25/24 340/5.26
6,154,544 A * 11/2000 Farris ..... G07C 9/00182 340/5.26
9,894,471 B1 * 2/2018 Zalewski ..... H04W 4/70
9,911,259 B1 * 3/2018 Ghabra ..... G07C 9/28
10,227,059 B2 * 3/2019 Casagrande ..... G06F 21/34
2003/0001723 A1 * 1/2003 Masudaya ..... B60R 25/24 340/5.61
2003/0189530 A1 * 10/2003 Tsui ..... G08C 19/28 345/48
2005/0055567 A1 * 3/2005 Libin ..... G07C 9/00007 726/26
2009/0206989 A1 * 8/2009 Leitch ..... B60R 25/24 340/5.61
2010/0259388 A1 * 10/2010 Menzel ..... H04B 5/0031 340/572.1
2011/0205014 A1 * 8/2011 Fitzgibbon ..... G07C 9/00857 340/5.6
2012/0187187 A1 * 7/2012 Duff ..... G06Q 10/00 235/382
2012/0231733 A1 * 9/2012 McManus ..... H04B 5/02 455/41.1
2014/0330449 A1 * 11/2014 Oman ..... B60R 25/245 701/2
2015/0261304 A1 * 9/2015 Kamisawa ..... G07C 9/00174 340/5.28
2015/0371467 A1 * 12/2015 Wang ..... G07C 9/00309 340/5.26
2016/0042602 A1 * 2/2016 Phan ..... G07F 17/3237 463/29
2017/0311161 A1 * 10/2017 Kuenzi ..... G07C 9/00904
2017/0372574 A1 * 12/2017 Linsky ..... G08B 13/1966
2020/0004227 A1 * 1/2020 Kang ..... H04W 4/80

* cited by examiner

ROLLING CODE BASED PROXIMITY VERIFICATION FOR ENTRY ACCESS

CLAIM OF BENEFIT TO RELATED APPLICATIONS

This application is a continuation of the U.S. non-provisional application Ser. No. 15/829,709, entitled "Rolling Code Based Proximity Verification for Entry Access", filed Dec. 1, 2017.

BACKGROUND ART

Proximity cards and smart cards have mostly replaced physical keys as an efficient and somewhat secure means for entry access, especially in offices and business applications. There is now a shift from proximity cards and smart cards to smartphones.

The moving of access control functionality into smartphones stems from the desire to eliminate the proximity card or smart card as a separate physical device that one has to carry for the singular purpose of access control. The smartphone is a device that is now ubiquitously carried on one's person at all times, is a multi-functional device that has the consolidated functionality of many different devices we used to carry (e.g., telephone, email, web browser, music player, video player, voice recorder, calculator, secure payment device, etc.), and includes the functionality to operate as a physical access card. In particular, smartphones, like physical access cards, have one or more antennas or radios to wirelessly communicate, and also integrated circuits to securely store and transfer access credentials.

However, security is a significant challenge when adapting a smartphone to act as an access control device. The fundamental basis for having access control is security. Therefore, if the smartphone can be tricked, hacked, or spoofed in circumventing the security measures put in place for access control, the smartphone becomes the weakest link and easy target for bypassing those security measures.

Proximity cards and smart cards activate when placed within a few inches of a reader that is in close proximity of an entry point where access is desired. The reader produces a magnetic field from which the proximity card or smart card draws power. The power is supplied to an integrated circuit on the card that then obtains and wirelessly transfers the user's access credentials to the reader via the card's antenna. The reader forwards the access credentials to an access control unit (ACU). The ACU stores the access privileges that different users have with respect to different entry points under control of the ACU. The ACU can then open access to the entry point that is in close proximity to the reader or deny access depending on the access credentials and associated access privileges.

Smartphones have batteries. The batteries power one or more wireless radios and processors of the smartphone. The one or more wireless radios and processors can collectively obtain and wirelessly transfer user access credentials like proximity cards and smart cards. However, the smartphones are not dependent on the reader for power and can wirelessly transmit the access credentials directly to the ACU without the reader acting as a proxy. In other words, the smartphones can request access even when away from the reader or point of access where access is desired. Thus, proximity verification becomes a security challenge with smartphones where it did not exist with physical access cards.

Proximity verification verifies that an entity using a smartphone to send an access request to a particular point of access is physically present at the particular point of access. Without proximity verification, attackers can attempt to remotely access different points of access without being physical present, and if successful, provide unknown third parties with access. Even authorized access can be compromised if an authorized user remotely opens access to allow another to enter without physically being present to supervise the access. These are just some examples of how security controls can be bypassed if smartphones are used as access control devices without proximity verification.

Global Positioning System (GPS) and geo-fencing functionalities of the smartphone have been used in the past to address proximity verification issue. GPS provides location coordinates. However, the coordinates do not provide sufficient location specificity to differentiate user location in a multi-floor office building or even where the user is inside of a building when the GPS signal is lost or sporadic at best. Moreover, continual location tracking via GPS becomes a huge drain of the smartphone battery. Periodic location tracking via GPS can be used to preserve battery. However, periodic location tracking reduces the accuracy of the GPS coordinates even further.

GPS is also insecure. The signaling is not encrypted or authenticated in any way and tools are publicly available to spoof GPS as well as other geo-fencing techniques, such as WiFi based location detection. Rooted or hacked devices can also have their GPS positioning manipulated such that a rooted or hacked device thinks it is in a different position than it actually is in. For all these reasons, proximity verification via GPS is therefore suspect at best.

Facial recognition, voice recognition, and other biometric identity techniques can be integrated into the readers to verify user proximity. However, these techniques might not provide a sufficient degree of accuracy and are subject to various attacks. More importantly, these techniques are slow, processor intensive, and require expensive sensors, thereby making them unacceptable for high traffic points of access or low-cost implementations.

Accordingly, there is a need to verify the proximity of a user to a secure resource or point of access when the user smartphone or other mobile device is the basis for authenticating user access to the secure resource or point of access. There is a need for the proximity verification to occur efficiently and securely so as to not introduce delay in how long it takes the user or device to perform access authentication and gain access. There is further a need for the proximity verification to occur inexpensively and without user involvement so as to not complicate or degrade the user experience when using the smartphone or other mobile device as the means of authenticating user access.

BRIEF DESCRIPTION OF THE DRAWINGS

A preferred embodiment for rolling code based proximity verification for entry access will now be described, by way of example only, with reference to the accompanying drawings in which.

DETAILED DESCRIPTION

Figure 1:
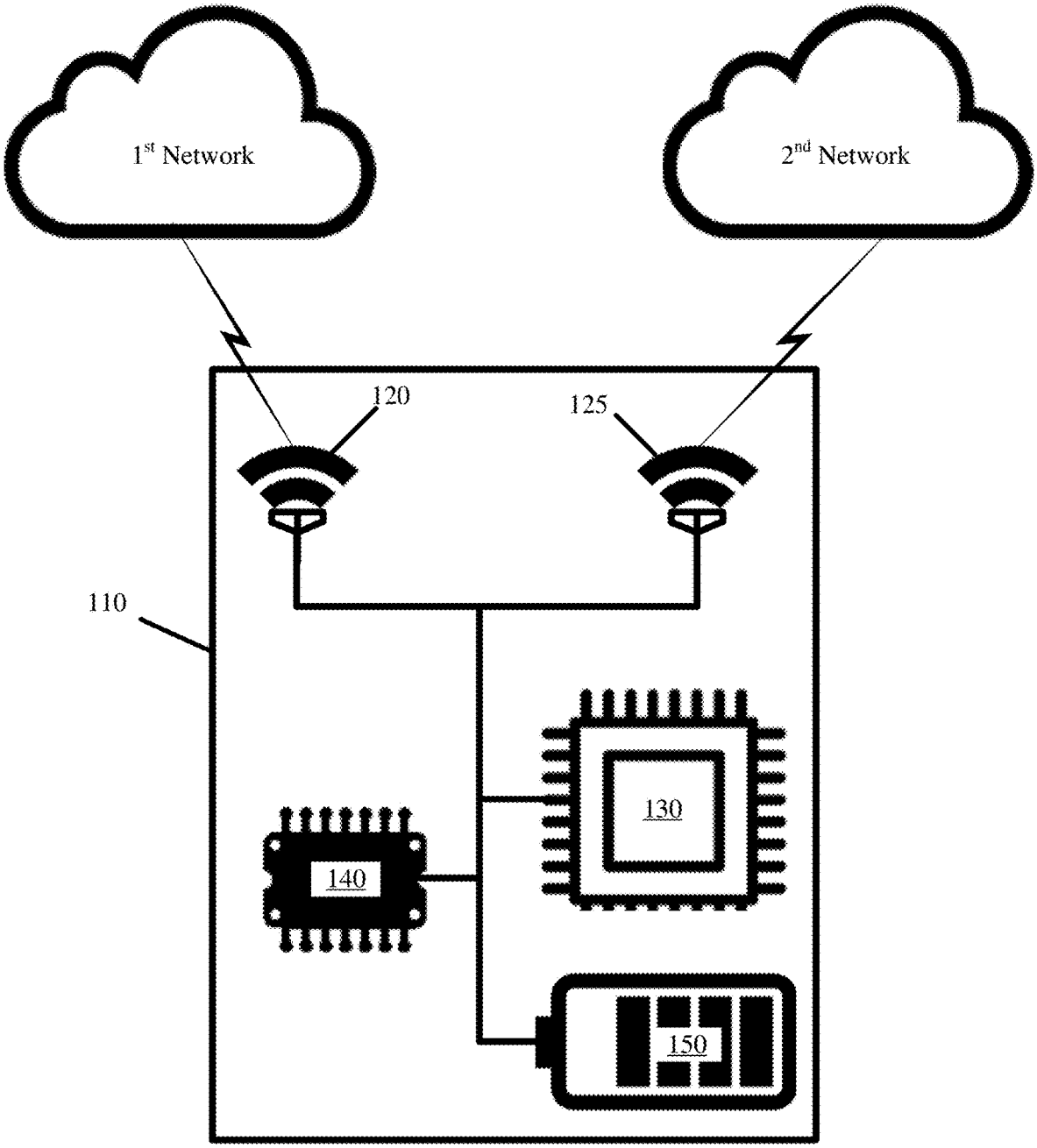
FIG. 1 conceptually illustrates a user device of some embodiments that can be used as part of the access control system performing rolling code based proximity verification.

Rolling code based location verification is provided for verifying user proximity to secure points of access. The rolling code based location verification is incorporated as part of an access control system that controls user access to different secure points of access or resources, and that authenticates user access to the different points of access or resources based on a wireless exchange of user access credentials from a user device carried on the user person.

In some embodiments, the access control system advertises changing identifiers from each secured point of access. The identifiers change based on a different rolling code that is generated at each secured point of access. Each identifier advertised from a particular secure point of access provides a unique identification for that secure point of access at a different point in time. The identifier can be comprised of a unique name assigned to the secure point of access and a rolling code that is appended, prepended, or otherwise attached to the unique name. The rolling code is a changing sequence of alphanumeric characters. A longer sequence ensures that the same rolling code is repeated less frequently. A longer sequence also makes it more difficult for an attacker to guess the rolling code or derive the algorithm or sequence of operations by which the rolling code is generated. The rolling code can also include symbols if supported in the network advertisement message format.

Some embodiments change the rolling code based on time and other embodiments change the rolling code based on use. In time based embodiments, the rolling code for each identifier or each point of access changes every few seconds. In use based embodiments, the rolling code for each identifier or each point of access changes upon a last advertised identifier being used. An identifier is used when a user device submits the identifier for proximity verification. In response to detecting usage of an identifier, the rolling code is changed, thereby producing a different unique identifier. The use based embodiments allow for synchronization of the rolling code without an accurate clock, wherein the synchronization is between a first device advertising the identifier and a second device accepting the identifier for proximity verification.

The rolling code identifiers are sent over different wireless networks or wireless technologies than the wireless networks or technologies used to wirelessly exchange user access credentials for access privilege authentication. In other words, the advertisements containing the rolling code identifiers are received by a user device over a first wireless network with a first wireless radio of the user device. The access credentials for authenticating user access to a particular secure point of access as well as a received rolling code identifier for the particular secure point of access are sent over a different second wireless network from the user device using a different second wireless radio of the user device.

In some embodiments, the first wireless network is a short-range wireless network or technology. The short-range radio transmission of the rolling code identifiers ensures that only user devices near a particular secure point of access receive the current rolling code identifier being advertised from that particular secure point of access. Consequently, the proximity of a user device to a particular secure point of access can be verified in response to the user device sending a current or recent rolling code identifier advertised from the particular secure point of access when requesting and authenticating access to that particular secure point from the access control system. The rolling code in each identifier prevents a user from accessing a secured point of access even if the user has permissions to access but provides a stale or incorrect identifier for the secured point of access when requesting access. The rolling code identifiers prevents someone from using a spoofed or hacked identifier to remotely access the secured points of access, and requires the requesting user device to be near the point of access before requesting access.

The advertisements are broadcast over the first wireless network such that user devices can detect the rolling code identifiers without establishing a connection or other communication channel with the secure point of access or access control system device from which the rolling code identifiers are advertised. In some embodiments, the rolling codes are included as part of changing service set identifiers (SSIDs) or names of different networks or devices representing the secure points of access under control of the access control system. In some embodiments, the advertisements are regularly broadcast every second or every few milliseconds. In preferred embodiments, the rolling code identifiers are advertised over Bluetooth. However, other wireless networks or technologies, such as Bluetooth Low Energy (BLE), Near Field Communications (NFC), or WiFi, could alternatively be used for the advertising of the rolling code identifiers.

Alternatively, the advertisements could be sent over the first wireless network after the user device establishes a connection with an advertising device. For instance, the user device may come in range with a reader or other device that is adjacent to a restricted point of access. Rather than broadcast the rolling code identifier, the reader waits until the user device is in range and a wireless connection is created between the user device and the reader before sending the rolling code identifier to the user. In establishing the connection with the user device, the reader can obtain certain information about the user device that it would not receive if simply broadcasting the rolling code identifier. As another example, the user device may be configured to automatically join a WiFi network within an office, whereby the SSID of the WiFi network does not include the rolling code identifier. Upon connecting to that WiFi network, the user device receives or is able to detect the rolling code identifiers that are sent only to user devices that can and have connected to that WiFi network. In some embodiments, the rolling code identifiers are advertised to the user device upon the user device handing off to and obtaining cellular service from a particular wireless base station. In some such embodiments, the rolling code identifiers may be sent via text messages. Alternatively, the rolling identifiers may be sent using control plane messaging or data plane messaging of the wireless cellular network. In still some other embodiments, the rolling code identifiers are emailed or instant messaged to the user device upon the user device coming in proximity of or joining a wireless network. As will be discussed in more detail below, waiting to send the rolling code identifier until there is some handshake or preliminary message exchange between the user device and the advertising device can also serve to defeat relay attacks and provide a second method of verifying the user device proximity to the advertising device.

Other transmission media in addition to or instead of the first wireless network can be used to present the rolling code identifiers to nearby user devices. Sound, light, and different radio frequencies are different transmission media that can be used to advertise the rolling code identifiers a controlled distance. In some embodiments, the rolling code identifiers are disseminated via sound waves at ultrasonic frequencies that are inaudible by humans but are detectable using a microphone and processor of the user device. Visible light formed on a screen, formed as a quick response (QR) code, or formed as a bar code could be used to advertise the rolling code identifiers. Invisible light, such as infrared or ultraviolet, could also be used to advertise the rolling code identifiers. In some such embodiments, pulses of light encode the rolling code identifier. The camera or other optical sensors of the user device can be used to receive the light and decipher the rolling code identifiers being advertised.

In some embodiments, the second wireless network is a long-range wireless network or technology. The long range allows the user device to be authenticated by an access control system authenticating device that resides in the "cloud" or on the premises albeit away from the user device and the secure point of access that the user device attempts to access. The access control system authenticating device could also be integrated as part of the device advertising the rolling code identifier from a particular point of access. In such cases, the short-range first wireless network may be low speed and low bandwidth, whereas the long-range second wireless network may be high speed and high bandwidth. Accordingly, the short-range first wireless network is used for advertising the rolling code identifiers the short or controlled distance from the advertising device, and the long-range second wireless network is used for speedy transfer of the access request and access credentials from the user device to the advertising device. In any case, the first wireless network through which the rolling code identifiers are advertised is different than the second wireless network through which user access is authenticated. In some embodiments, the second wireless network is 4G Long Term Evolution (LTE), 5G, 3G (e.g., Universal Mobile Telecommunications System or General Packet Radio Service), WiFi, or other longer-range wireless network.

The use of different networks is preferable because the different network offer different ranges and speeds with which to separately achieve the proximity verification and fast authentication. The use of different network also serves to decouple the distribution of the rolling code identifiers from the access authentication. This greatly simplifies the logic for the devices at the secure points of access that advertise the rolling code identifiers. However, as noted above, the separate logic for advertising the rolling code identifiers and authenticating user access can be combined in a device that resides next to a secure point of access.

The use of different networks also allows the user devices to authenticate directly with one or more access control units (ACU) of the access control system rather than send access credentials to a reader that then proxies the access credentials to the ACU as is done with proximity cards and smart cards. Faster performance and access response is gained as a result.

The rolling code identifiers can be advertised from each secure access point and received by a user device every 15 milliseconds (ms). However, to establish a secure Bluetooth connection between the secure access point and the user device could take multiple seconds. Once the Bluetooth connection is established, a subsequent exchange of the access credentials occurs over the low bandwidth Bluetooth connection between the user device and secure access point with the secure access point then acting as a proxy in order to send the access credentials to the remote ACU for the access decision to be made. Even in the existing proximity card and smart card model, the time to energize the card, transfer the access credentials to the reader, and have the reader proxy the access credentials to the ACU takes a few seconds. By using two different wireless networks, the user device can continue to receive the rolling code identifiers from the secure access points every 15 ms without establishing a connection with the secure access points. The user device can then use the high bandwidth second network (e.g., 4G or WiFi) in order to quickly and securely send the access credentials to the ACU. The entire authentication over the combined use of the first and second wireless networks completes within a few hundred milliseconds.

FIG. 1 conceptually illustrates a user device 110 of some embodiments that can be used as part of the access control system performing rolling code based proximity verification. As shown, the user device 110 has a first wireless radio 120, a second wireless radio 125, a processor 130, memory/storage 140, and a battery 150.

The first wireless radio 120 wirelessly communicates over the first wireless network with proximity hubs of the access of system. As will be described in detail below, the proximity hubs replace or enhance readers used in proximity card or smart card access control systems. The proximity hubs advertise the rolling code identifiers near the access control system points of access. In preferred embodiments, the first wireless radio 120 is a Bluetooth radio.

The second wireless radio 125 wirelessly communicates over the different second wireless network with the ACU of the access control system that authenticates user credentials. In preferred embodiments, the second wireless radio 125 is a 4G, 5G, or WiFi radio.

The battery 150 provides an onboard power source. The processor 130 and memory/storage 140 provide secure storage and transfer of the user access credentials.

FIG. 1 is illustrative of smartphone devices that are ubiquitously carried on one's person nearly all times of the day. The user device of FIG. 1 can include other devices as well including tablets, portable digital assistants, wearable devices, Internet-of-Things (IoT) devices, and other mobile devices.

In preferred embodiments, the access control system controls access to physical locations. In some such embodiments, the access control system controls the locking and unlocking of different points of access. The points of access are typically doors, but can also include gates, elevators, windows, and other physical barriers that prevent users from accessing different spaces or locations. In some embodiments, the access control system controls access to other secure resources. These resources can include computers, vehicles, equipment, other devices, end even intangible assets that have shared usage.

Figure 2:
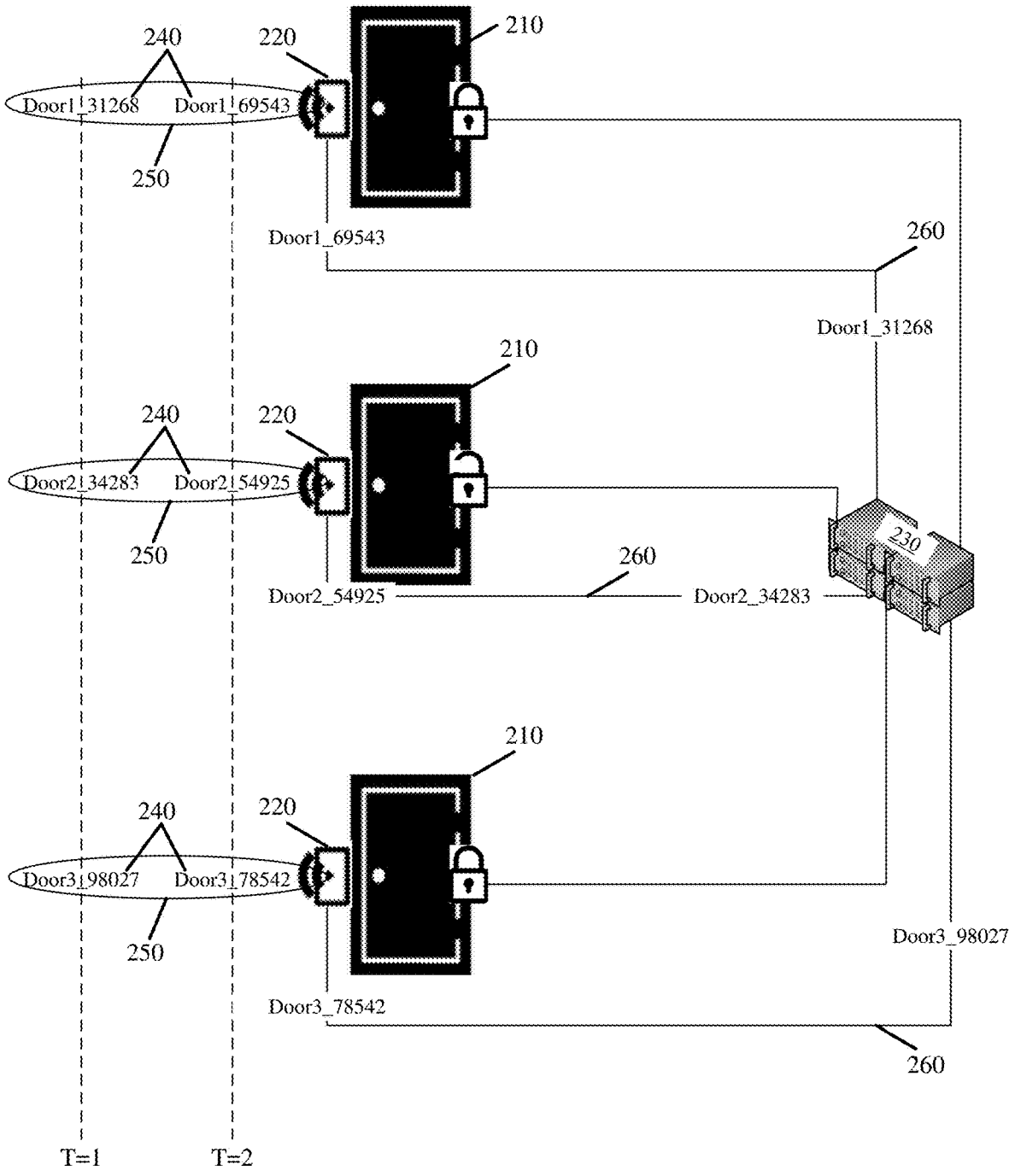
FIG. 2 conceptually illustrates an access control system in accordance with some embodiments.

FIG. 2 conceptually illustrates an access control system in accordance with some embodiments. The access control system is formed by different points of access 210, a proximity hub 220 adjacent to each point of access 210, and at least one ACU 230.

Each proximity hub 220 advertises a changing identifier 240 over a first wireless network 250. Each proximity hub 220 changes the advertised identifier 240 based on a rolling code that changes every few seconds. The figure illustrates identifiers 240 with different rolling codes advertised by the proximity hubs 220.

Each proximity hub 220 includes circuitry and logic for a rolling code generator. The rolling code generator can be a random number generator, a pseudo-random number generator, or other deterministic algorithm. In embodiments based on a random or pseudo-random number generator, the number generator of each proximity hub 220 is seeded with a different value. Based on the seed value and the current time, the number generator generates different rolling codes. Some embodiments use a secure algorithm, such as CSPRNG (cryptographically secure pseudo-random number generator), for the generation of the rolling codes. The secure algorithm produces a deterministic output based off of a number of initial inputs, primarily a seed (secret) and beginning counter value (a number that changes based off of a known state, such as time or uses). In any case, the rolling codes are attached to the SSID or name advertised from the proximity hub 220. The SSID or name may be descriptive and unique to each proximity hub 220, such as "north door" and "south door", or a common name, such as "companyABCdoor". In either case, the advertised identifiers 240 are made unique by appending or otherwise including the generated rolling code as part of the proximity hub name.

Each proximity hub 220 further includes at least the first wireless radio (also on the user device) for wirelessly advertising the identifiers 240 over the first network 250, such as Bluetooth. The advertisements or rolling code identifiers 240 are in plain text and not encrypted such that any device with a corresponding first wireless radio that is active can see the advertisements and extract the changing identifiers 240 therefrom. In some embodiments, the range of the first wireless radio is configurable such that user devices detect the advertisements a specified distance from the proximity hub 220. For instance, the first wireless radio of each proximity hub 220 can be tuned to advertise to a distance no greater than ten feet from the proximity hub 220.

As shown in FIG. 2, each proximity hub 220 can optionally have a second network connection 260, whether wired or wireless, to the ACU 230. This second network connection 260 can be used by the proximity hubs 220 to update the ACU 230 with the current identifier or rolling code 240 that is advertised by each proximity hub 220. Alternatively, the second network connection 260 can be used by the ACU 230 to update the current identifier or rolling code 240 that each proximity hub 220 should advertise. In other words, synchronization of the current identifier or rolling code 240 can be keyed off messaging initiated by the proximity hubs 220 or the ACU 230 depending on which device generates and updates the current identifier or rolling code 240. In either case, the second network connection 260 to the ACU 230 is encrypted to prevent third-party interception of the changing identifiers 240. The second network connection 260 can also be used by the proximity hubs 220 to proxy user credentials and other access authentication information from user devices to the ACU 230.

The second network connection 260 to the ACU 230 can be optional. This is because, in some embodiments, the ACU 230 is configured with and executes the same rolling code generator (e.g., random number generator, pseudo-random number generator, secure algorithm) as the proximity hubs 220. The ACU 230 is also configured with the same inputs (e.g., seed value) as used by the rolling code generator of each proximity hub 220. Accordingly, the ACU 230 can locally generate the same identifiers 240 or rolling codes as each proximity hub 220 without the proximity hubs 220 communicating the identifiers 240 or rolling codes to the ACU 230.

As noted above, some embodiments change the rolling codes based on time or usage. For instance, the ACU 230 and each proximity hub 220 can be configured to change the rolling codes every five minutes. Alternatively, the ACU 230 and a particular proximity hub 220 advertising a particular rolling code identifier can increment or change the particular rolling code identifier once that particular rolling code identifier is used. This synchronized and independent changing of the rolling codes eliminates a potential point of attack or security vulnerability as it prevents secret material (e.g., seed) from traveling between the proximity hubs 220 and the ACU 230 more than necessary. The synchronized and independent changing of the rolling codes is also beneficial for low bandwidth connections or locations where communication between the proximity hubs 220 and ACU 230 is not feasible or reliable.

In some embodiments, each proximity hub 220 has functionality to locally authenticate user access without communicating with the ACU 230. In some other embodiments, the proximity hub 220 also operates as a reader of proximity cards or smart cards. In such cases, the proximity hub 220 generates the magnetic field to power the physical access cards and has an antenna to receive access credentials from the cards. This functionality allows the proximity hubs 220 to have a dual-purpose and work with legacy physical access cards while also supporting smartphone or other user mobile device access authentication.

The ACU 230 is the access authenticating device of the access control system. The ACU 230 stores which users have access permissions to which secure points of access 210. The access permissions can be conditioned on different parameters. For example, time can be used as a condition that limits access for a set of users to a particular point of access to certain times within the day.

The ACU 230 has network connectivity from which access requests sent from user devices over the second wireless network can be received. The ACU 230 need not have a wireless radio for receiving the access requests send from the user devices over the second wireless network. The ACU 230 can have a wired Ethernet interface or other networking port. This is because messages sent from the user devices over the second wireless network route through different networks before arriving at the ACU 230. In some embodiments, the ACU 230 network connectivity is further leveraged to communicate with each proximity hub 220 as described above in order to receive the current identifiers 240 or rolling codes advertised by the proximity hubs 220, and also access authentication requests made by users through the proximity hubs 220 whether with a smartphone or legacy physical access cards. In some embodiments, the ACU 230 network connectivity is further leveraged to connect the ACU 230 to each secure point of access 210 under the ACU's 230 control. The ACU 230 can control access to each secure point of access 210 with the network connectivity, including sending commands that unlock or lock the points of access 210. In some embodiments, the ACU 230 components and logic are integrated as part of each proximity hub 220 in order to perform local and distributed access authentication at each secure point of access.

The ACU 230 can be located on premises or in the same building or campus as the proximity hubs 220 or points of access 210 under the ACU's 230 control. In some such embodiments, the ACU 230 can be communicatively coupled to a cloud based ACU. Access requests from user devices can be either to the on premises ACU 230 or to the cloud based ACU depending on network connectivity and speed. The cloud based ACU can authenticate user access in the cloud and directly grant or deny access to various points of access under control of the ACU 230. Alternatively, the cloud based ACU can simply forward the access requests to the ACU 230 that is on premises. In still some other embodiments, the ACU 230 is located in the cloud and thus off premises and remote from the points of access 210 that are under its control. Network connectivity renders the physical location of the ACU 230 moot as the locking and unlocking of the points of access 210 can be controlled by the ACU 230 whether the ACU 230 is remotely located in the cloud or is on premises.

Figure 3:
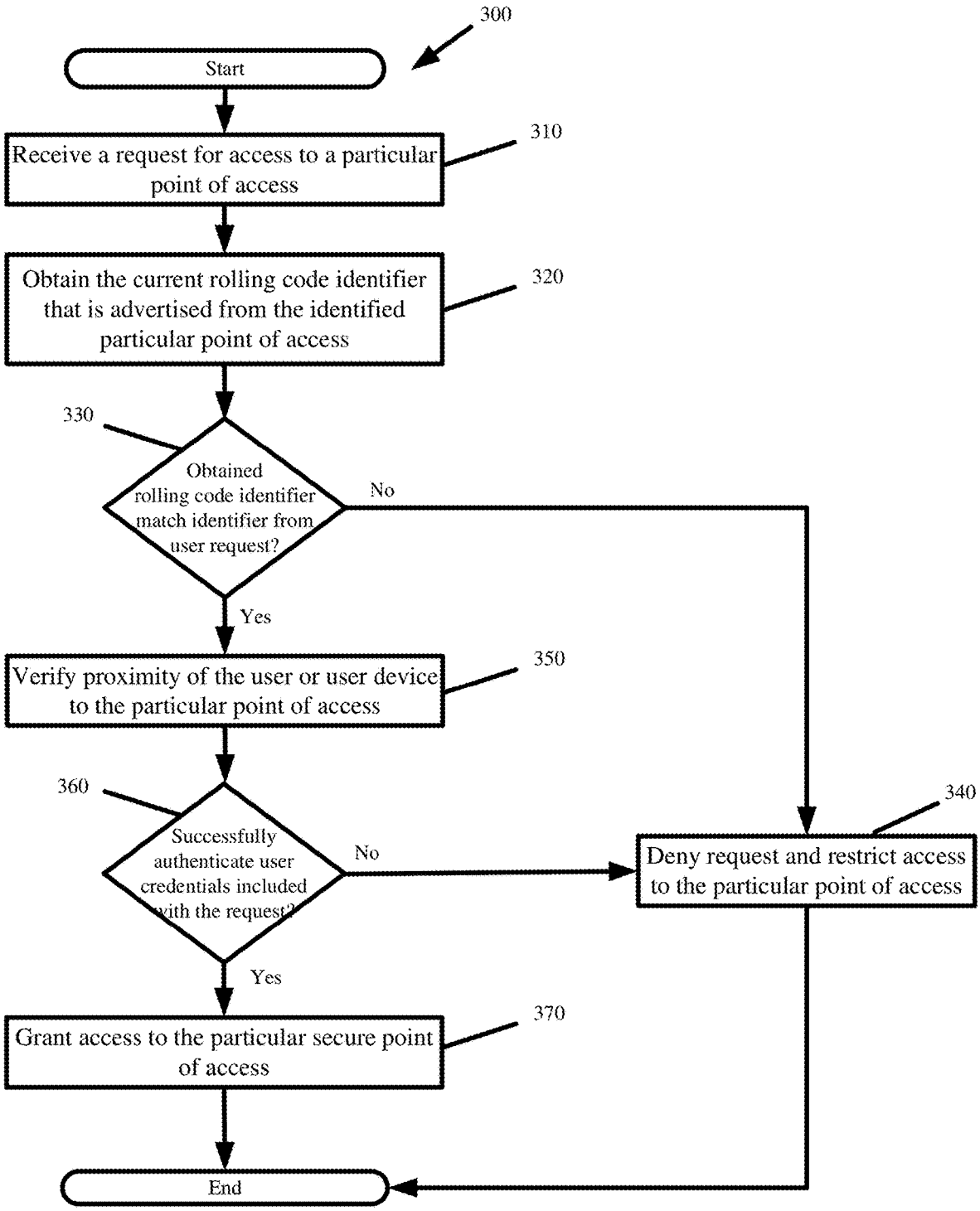
FIG. 3 presents a process by which an access control unit (ACU) authenticates access with proximity verification in accordance with some embodiments.

The access authentication performed by the ACU 230 of some embodiments differs from the access authentication performed by traditional ACUs because the ACU 230 of some embodiments performs user proximity verification in addition to authenticating access credentials and access privileges of a user. FIG. 3 presents a process 300 by which an ACU authenticates access with proximity verification in accordance with some embodiments.

The process 300 commences in response to the ACU receiving (at 310) a request for access to a particular secure point of access under control of the ACU. The request includes access credentials for the user or user device submitting the request as well as the identifier for the particular secure point of access that is the target of the request. The process identifies the particular secure point of access that is the target of the request from the request, and more specifically, from the identifier for the particular secure point of access.

The process obtains (at 320) the current rolling code identifier that is advertised from the identified particular secure point of access. As noted above, the proximity hub at the particular secure point of access can update the ACU with the newest rolling code identifier whenever it changes the rolling code. In some such embodiments, the ACU retains the current rolling code from each proximity hub in memory. Alternatively, the ACU can generate the rolling code identifier from the same seed value that is used by the random number generator or pseudo-random number generator of the proximity hub at the particular secure point of access and the current time in some embodiments. In some such embodiments, the ACU is configured with the seed value assigned to each proximity hub. In some embodiments, the process also obtains one or more rolling code identifiers that were advertised immediately before the current rolling code identifier. This accounts for drift and network delay and allows access authentication to continue and complete even if the current rolling code changes during the access authentication procedure.

The process compares (at 330) the obtained one or more rolling code identifiers to the identifier included with the user request. The comparison determines if the identifier included with the user request has the rolling code that is included with any of the recently advertised identifiers from the particular secure point of access.

In response to no match, the process determines that the request includes a stale, invalid, or spoofed identifier for the particular secure point of access. The proximity of the requesting user to the particular secure point of access therefore cannot be verified. Accordingly, the process denies (at 340) the request and does not grant access to the particular secure point of access.

In response to a match, the process verifies (at 350) the proximity of the user or user device to the particular secure point of access. Accordingly, the process continues to perform the second phase for access authentication.

The second phase of access authentication involves authenticating (at 360) the user credentials included with the request. The user credentials can be any secure identification of the user or user device. In some embodiments, the user credentials are a username and password combination or an encrypted security token that the ACU previously provided to the user device. Authenticating the user credentials involves identifying the requesting user or user device and also identifying access privileges of the user or user device to the particular secure point of access. The access privileges identify whether the user is permitted access through or to particular secure point of access and when or how the access is permitted.

Should the access authentication fail, the process denies (at 340) the request and does not grant access to the particular secure point of access. However, should the access authentication succeed, the process grants (at 370) access to the particular secure point of access. In some embodiments, the process grants access by unlocking or otherwise opening the particular secure point of access for a temporary period of time during which the user can gain access. For instance, the ACU can unlock an electric strike (i.e., allow the electric strike to pivot from a locked position), thereby allowing a door that is locked by the electronic strike to be opened.

Figure 4:
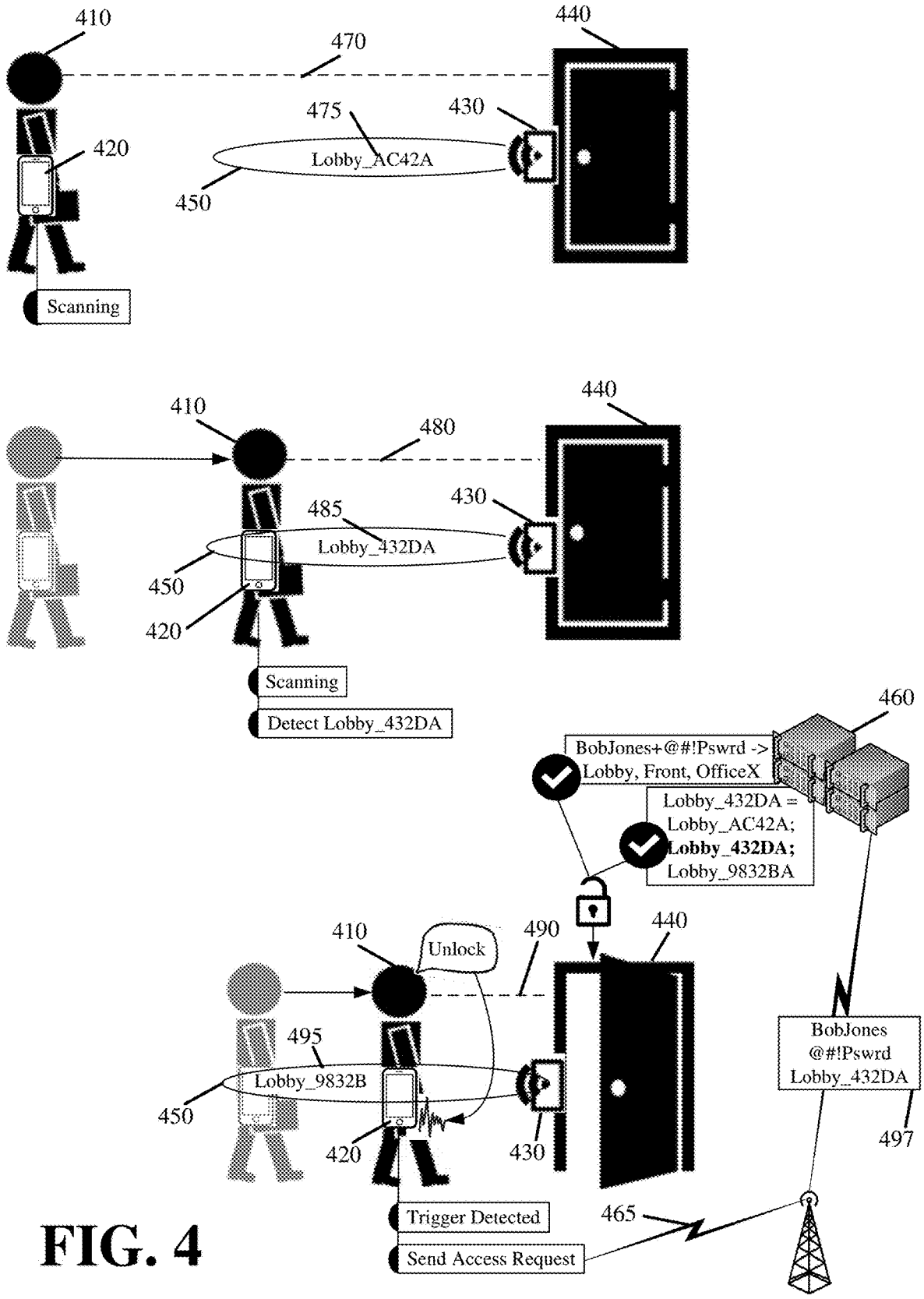
FIG. 4 illustrates entry access based on the rolling code proximity verification of some embodiments.

FIG. 4 illustrates entry access based on the rolling code proximity verification of some embodiments. The figure illustrates a user 410 with a smartphone 420 at different times and distances from a proximity hub 430 and a particular point of access 440 associated with the proximity hub 430. In accordance with the disclosed embodiments, the proximity hub 430 advertises identifiers with a changing rolling code at the different times and distances over a first wireless network 450. The figure also illustrates an ACU 460 that controls access to the particular point of access 440.

At the first time and distance 470, the proximity hub 430 advertises an identifier with a first rolling code value 475. However, the smartphone 420 is not within range of the first wireless network 450 created by the proximity hub 430 and therefore cannot detect the advertising of the identifier with the first rolling code value 475 over the first wireless network 450.

At the second time and distance 480, the proximity hub 430 advertises its identifier with a different second rolling code value 485. The smartphone 420 is now within range of the first wireless network 450 and detects the proximity hub 430 advertisement with the identifier having the second rolling code value 485. However, the user 410 has yet to trigger an access request targeting the particular secure point of access 440. In some embodiments, the user 410 triggers the request by performing some gesture that is detected by a sensor of the smartphone 420. For example, the user 410 can perform a touch-based gesture (i.e., a knocking gesture) on the smartphone 420, speak an audible command (i.e., "open door"), or move the smartphone 420 with a particular motion.

At the third time and distance 490, the user 410 triggers the request by speaking a particular phrase at or before the proximity hub 430 changes its advertisement from the second rolling code value to a third rolling code value 495 and before the smartphone 420 detects the changed advertisement. In response to the user 410 triggering the request, the smartphone 420 automatically obtains the user's access credentials from a secure or encrypted memory location on the smartphone 420 and sends a request 497 to the ACU 460 over a different second wireless network 465. The request 497 provides the ACU 460 with the user's access credentials as well as the proximity hub identifier with the second rolling code value 485.

Although FIG. 4 illustrates the request 497 as a single message being passed to the ACU 460, the request 497 may involve an exchange of several messages between the ACU 460 and the smartphone 420. In particular, the smartphone 420 may perform a handshaking procedure in order to establish a secure or encrypted connection with the ACU 460. This may include establishing a Transport Layer Security (TLS) connection with the ACU 460. The TLS connection encrypts all messaging passing between the two endpoints 420 and 460. The smartphone 420 may then send an HyperText Transfer Protocol (HTTP) GET message to request access. The message can also be sent using HTTP over TLS, HTTP over Secure Sockets Layer, or HTTP Secure. The ACU 460 can reply by asking for the user access credentials and/or rolling code identifier for the desired particular point of access 440. The smartphone 420 then responds with the requested data over the secure connection.

With reference back to FIG. 4, the ACU 460, upon receipt of the request 497 from the smartphone 420, determines that the request 497 is directed to the particular point of access 440 from a set of points of access based on the identifier name. The ACU 460 retrieves the current and previous two rolling code values advertised by the proximity hub 430. The ACU 460 verifies the proximity of the user 410 to the particular point of access 440 based on the second rolling code value 485 from the request 497 matching one of the retrieved rolling code values for the particular point of access 440. The ACU 460 also obtains the access privileges for the user 410 in response to authenticating the user's access credentials. The access privileges for the user 410 indicate that the user 410 is permitted access to the particular point of access 440. Accordingly, the ACU 460 opens access to the particular point of access 440 by unlocking the door via a command that the ACU 460 sends to the electronic lock on the particular point of access 440.

By the time the user 410 walks and reaches the final distance immediately before the particular point of access 440, the ACU 460 has successfully completed the two phases of the access authentication for the user 410. Accordingly, the particular point of access 440 is unlocked and ready for the user 410 to pass through without the user 410 having to perform any other actions other than to walk through.

FIG. 4 illustrates the smartphone 420 sending the access request over the second wireless network 465 in response to the user trigger. In some embodiments, the smartphone simultaneously or contemporaneously sends the access request over the second wireless network and a different wireless network in response to the user trigger. This can include sending the request over a 4G wireless network and also an available WiFi network. This creates a race condition causing the ACU to respond to whichever request is received first. Alternatively, the request can be simultaneously sent over the second network and the first network with the proximity hub acting as a proxy that forwards the request received over the first network from the smartphone to the ACU over a backhaul network connection the proximity hub has with the ACU.

It is possible that the user triggers a request for access to a particular point of access on the user device before the user device detects the rolling code identifier for that particular point of access. This scenario is illustrated by FIG. 5.

Figure 5:
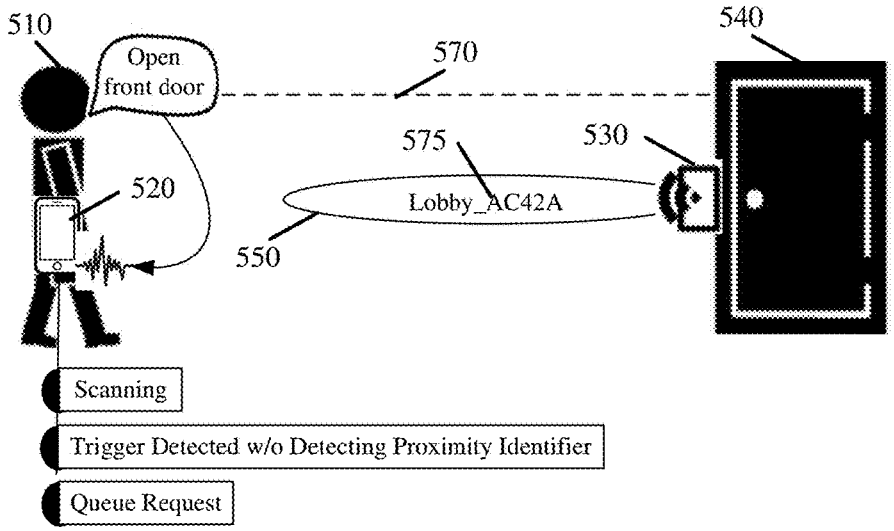
FIG. 5 illustrates entry access with proximity verification in accordance with some embodiments whereby the user triggers a request for access to a particular point of access on the user device before the user device detects the rolling code identifier for that particular point of access.
Figure 5:
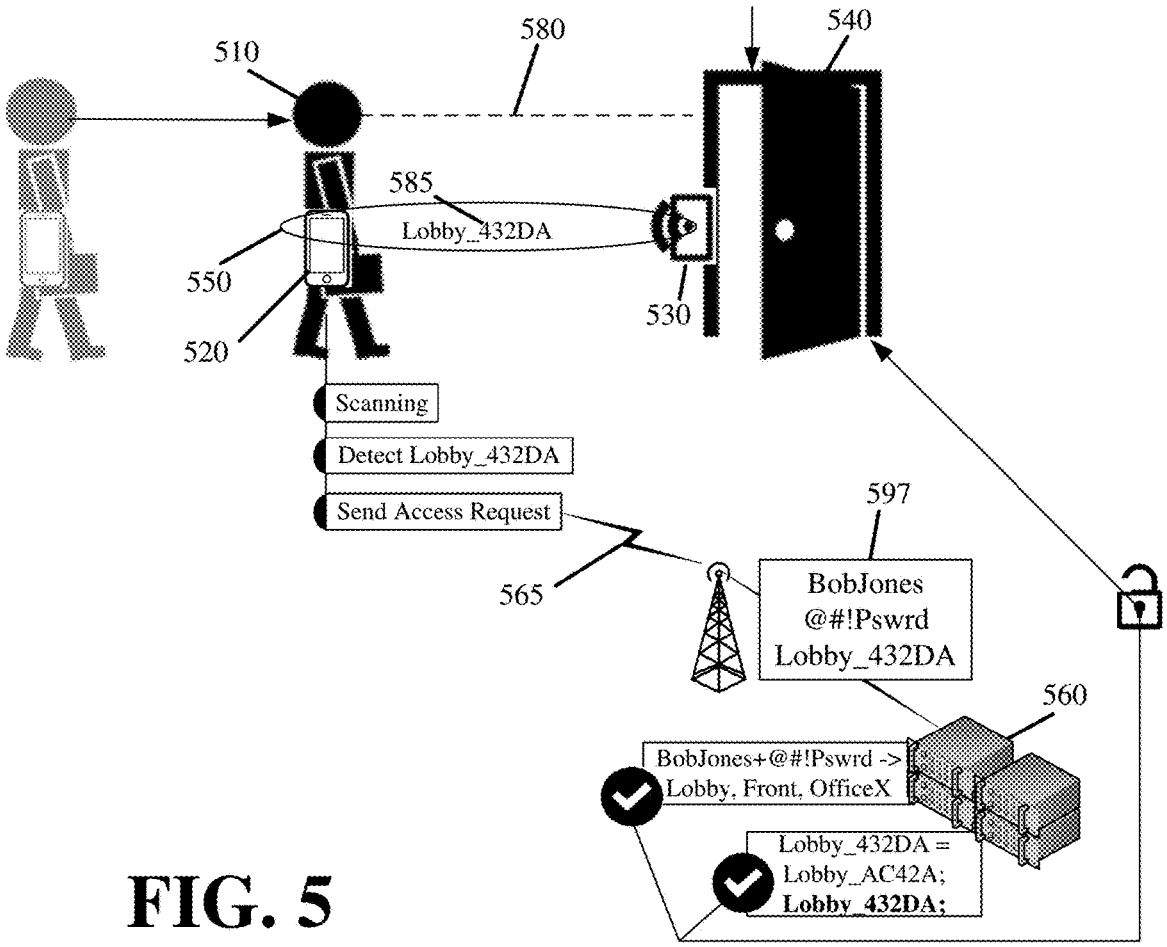

As shown in FIG. 5, when the user 510 is at a first time and distance 570 from the proximity hub 530, the user 510 performs an action 515 for triggering a request to access the particular point of access 540 that is adjacent to the proximity hub 510. In this figure, the user 510 speaks the command "open front door", and the command is detected by the smartphone 520 microphone. However, the user smartphone 520 is too far from the proximity hub 530 and not in range to detect the identifier with a first rolling code value 575 being advertised by the proximity hub 530 over the first wireless network 550. Rather than send the request to access the particular point of access 540 without the rolling code identifier for the particular point of access 540 which will be automatically rejected by the ACU 560, the smartphone 520 queues the request for a short period of time (e.g., 2 minutes) to determine if the rolling code identifier can be obtained in that period of time.

At a second time and distance 580 from the proximity hub 530 that is within the short period of time that the request is queued by the smartphone 520, the user 510 enters within range of the first wireless network 550. By this time, the proximity hub 530 changes the rolling code for the identifier from a first rolling code value to a different second rolling code value 585. The smartphone 520 detects the advertisement with the identifier and the second rolling code value 585 for the particular point of access 540. In some embodiments, the smartphone 520 can determine that the advertisement is indicative of an access control system point of access. The smartphone 520 also detects the previously queued request or request trigger. Accordingly, the smartphone 520 sends the request 590 with the user access credentials and the identifier with the second rolling code 585 to the ACU 560 over the second network 565.

The ACU 560 verifies proximity of the user 510 to the particular point of access 540 based on the identifier with the second rolling code 585 and authenticates user privileges to the particular point of access 540 based on the access credentials in the request. Consequently, the ACU 560 opens access to the particular point of access 540. If a rolling code identifier for a queued request is not obtained within the specified amount of time, the request is ignored or a notice is provided to the user as to why access cannot be granted.

In some embodiments, the ACU 560 signals the proximity hub 530 that the current advertised rolling code identifier has been used. In response, both the ACU 560 and the proximity hub 530 perform a synchronized change to the rolling code identifier. In some embodiments, the synchronized change involves the ACU 560 and the proximity hub 530 incrementing the rolling code portion of the identifier by some synchronized amount. In doing so, the proximity hub 530 can advertise a new unique rolling code identifier and the ACU 560 is aware of the new unique rolling code identifier for verifying proximity to the proximity hub 530 or point of access 540 without a clock to synchronize the changing of the rolling code identifier and without the proximity hub 530 or ACU 560 communicating the new unique rolling code identifier to one another.

In some embodiments, the access authentication logic can be moved from the ACU into the user device. The user device continues to scan for and receive the rolling code identifiers when in range of a proximity hub. In some such embodiments, the rolling code identifiers can be encrypted to store certain authentication information with which the user device can locally make an access control decision. The user device may decrypt the rolling code identifier using a decryption key that is hidden from the user. If the decrypted information is valid and the user has the proper credentials to access the nearby point of access, the user device sends the unlock command or other access command directly to the point of access or the proximity hub that may then unlock the point of access.

A "relay" attack is one means by which to potentially circumvent the proximity verification. The attacker could leave a relay device near one of the proximity hubs. The relay device listens for the rolling code identifiers advertised from that proximity hub and transmits the rolling code identifiers over a long-range network (e.g., cellular, 4G, 5G, etc.) to the attacker at remote location. The attacker can then issue access requests with the correct rolling code identifier from the remote location, thereby spoofing or faking proximity to the proximity hub or the corresponding point of access. For added security and to combat such techniques of circumventing the proximity verification, some embodiments employ radio frequency (RF) distance bounding in addition to the proximity verification described above.

The RF distance bounding is a secondary check with which the proximity hub measures the amount of time it takes for a mobile device to return a rolling code advertised from the proximity hub. In some embodiments, the RF distance bounding initiates in response to a handshake or other preliminary message exchange between the proximity hub and mobile device. Through the handshake, the proximity hub notifies the mobile device that it will send a rolling code identifier and that the mobile device is to respond immediately upon receiving the rolling code identifier. The proximity hub then measures with an accurate clock the time between sending the rolling code identifier and receiving the response from the mobile device. No other operations including the access credential authentication should be performed at this time.

The exchange occurs at a very high speed (e.g., near the speed of light) when performed using RF. Some padding is provided for the measured time to account for processing time on the mobile device.

The RF distance bounding detects relay attacks based on the additional time it would take to relay the rolling code identifier to the remote location of the attacker and for the attacker to send back the rolling code identifier to the proximity hub. The measurement remains effectively the same when using light or sound instead of RF. When using light, the measurement will remain near the speed of light. When using sound, such as ultrasound, the measurement is based off of the speed of sound.

The proximity hub can notify the ACU whether or not proximity of a user device has been secondarily verified with the RF distance bounding. Alternatively, a point of access may be unlocked in response to a primary unlock command from the ACU after user credentials are authenticated, and a secondary unlock command from the proximity hub after proximity of the user device has been secondarily verified with the RF distance bounding In other cases, it may be preferable to eliminate proximity verification altogether. For instance, proximity verification may be required for some users but not for other users. Security officers or executives of a company may be provided with remote access permissions while other employees of the company may be subject to the proximity verification based on the rolling code identifiers disclosed herein. In some embodiments, the ACU may be configured with parameters that identify whether or not a user is subject proximity verification. When authenticating user credentials, the ACU checks whether proximity verification is required for an authenticated user. If not, access is granted based on the user's access privileges obtained as a result of authenticating the user or the user's access credentials. Otherwise, access is conditioned upon authentication of the user or user access credentials as well as verifying the proximity of the user to the point of access that is the target of the user access request.

The advertised identifiers may have limited space with which to include the rolling code. Accordingly, some embodiments perform a base64 encoding of the point of access identifier and the rolling code to allow for more randomized and larger rolling code identifiers.

Some embodiments include metadata with the advertisements. The metadata can be used to provide additional information with the advertisements. The additional information can immediately notify the smartphone of a point of access that cannot be accessed because the current time is outside normal hours of access or because of an emergency or security situation. The additional information passed with the rolling code identifiers of some embodiments can also be used to notify the smartphone as to congestion at the point of the access or other networks with which the smartphone can perform user access credential authentication. These notifications improve performance by indicating which networks are least congested and should be used for access credential authentication. Other metadata can notify as the number of prior accesses through the point of access or specific users that have accessed the point of access. Generally, the metadata can be used to convey state of the point of access, state of the access control system, or provide instruction to the user device.

Backup proximity verification is provided in instances where proximity verification cannot be completed for a user device based on the rolling code identifiers. The user device may not receive the rolling code identifiers because the short range wireless radio is off, the user device does not have the proper wireless radio to receive the advertisements, the nearby proximity hub experiences errors that prevent the advertisements from being sent or read, or because all of the wireless communications slots on the proximity hub are occupied.

In some embodiments, backup proximity verification is performed based on Global Positioning System (GPS) drift. GPS drift is the phenomenon whereby the location coordinates detected by a stationary GPS receiver from different GPS satellites slightly change as the satellites orbit above. The slight changes are typically the result of changing interference in the signal path between the satellites overhead and the stationary GPS receiver on the ground. Triangulation is used in part to account for any GPS drift, wherein triangulation uses the GPS signals from different satellites orbiting the Earth at different locations to pinpoint the exact location of a device on the ground. First and second devices that are nearby experience similar GPS drift from each of the satellites, whereas first and third devices that are apart will experience different GPS drift from each of the satellites.

To perform backup proximity verification based on GPS drift, some embodiments enhance the proximity hubs with a GPS receiver. The proximity hubs track the GPS drift of one or more satellites and periodically send tracked GPS drift to the ACU. Almost all user devices (e.g., smartphones) have GPS receivers. Accordingly, the user devices can also track the GPS drift from the same one or more satellites and send the tracked GPS drift to the ACU directly or indirectly through the proximity hub. The ACU can compare the GPS drift reported by the proximity hubs and a particular user device in order to verify the proximity of the particular user device to a particular proximity hub or point of access. As noted above, the proximity to a particular proximity hub is verified in response to the GPS drift tracked by the particular proximity hub being similar to the GPS drift tracked by the user device. In response to verifying proximity of the particular user device and authenticating the user access credentials, the ACU can then grant access to corresponding point of access by unlocking or otherwise opening that point of access.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

We claim:

1. A method comprising:

broadcasting a periodically changing rolling code from a device, that is associated with a secured resource, the rolling code corresponds to a changing name of one of more of a wireless network, a wireless device or the secured resource;

receiving a request comprising a first value and a second value from a user mobile device in response to the user mobile device receiving the rolling code using a Bluetooth radio when the rolling code corresponds to a changing Bluetooth device name, or receiving the rolling code using a WiFi radio when the rolling code corresponds to a changing service set identifier (SSID);

obtaining a set of rolling codes recently advertised from the device based on the first value from the request matching a static identifier uniquely identifying the device or the secured resource from a set of devices or a set of secured resources; and providing access to the secured resource based on (i) the first value from the request matching the static identifier uniquely identifying the device or the secured resource, and (ii) the second value from the request matching one of the set of rolling codes.

2. The method of claim 1 further comprising obtaining access credentials from a physical access card, proximity card, or smart card placed over the device, and providing access to the secured resource based on the access credentials from the physical access card, the proximity card, or the smart card being authorized to access the secured resource.

3. The method of claim 1 further comprising generating a magnetic field from the device, the magnetic field providing power to a physical access card, a proximity card, or a smart card placed in the magnetic field, and causing the physical access card, the proximity card, or the smart card to transmit data to the device.

4. The method of claim 1, wherein the changing name comprises a changing Bluetooth device name or changing service set identifier (SSID).

5. The method of claim 1 further comprising restricting access to the secured resource based on (i) the first value from the request differing from the static identifier uniquely identifying the device or the secured resource, or (ii) the second value from the request not matching one of the set of rolling codes.

6. The method of claim 5, said restricting comprises locking or retaining a locked state of the secured resource.

7. The method of claim 1, wherein providing access comprises unlocking an electronically controlled lock or a mechanical lock of the secured resource.

8. The method of claim 1, wherein said broadcasting comprises advertising a plurality of messages at different times, wherein each message comprises the static identifier and a different rolling code value, and wherein the static identifier may come before or after the different rolling code value in the message.

9. The method of claim 1 further comprising receiving access credentials from the user mobile device.

10. The method of claim 9, wherein said providing comprises selecting a set of authorized users or devices for the secured resource from other sets of authorized users or devices for other secured resources based on the first value from the request, and authorizing access to the secured resource based on the access credentials being associated with an authorized user or device from the set of authorized users or devices.

11. The method of claim 1 further comprising tracking the set of rolling codes recently advertised from the device at an access control unit (ACU), that is remote from the device, based on the ACU and the device being configured with a particular seed value for generating the rolling code, and wherein said providing comprises matching, at the ACU, the first value from the request to the static identifier, and matching the second value from the request to one of the set of rolling codes.

12. The method of claim 11, wherein said providing comprises issuing an open command from the ACU to the secured resource.

13. A method comprising:

distributing at least two different messages from a particular device at different times to one or more user mobile devices in wireless range of the particular device, wherein each message of the at least two messages is formed from a common first value and a different second value;

detecting, at a user mobile device of the one or more user mobile devices, a spoken phrase or a user touch as an indication to request access to a secured resource using a message previously distributed by the particular device;

queuing commencement of an access request procedure by the user mobile device in response to detecting the spoken phrase or the user touch for a particular period of time after a first message of the at least two different messages is distributed and before a second message of the at least two different messages is distributed; and commencing performance of the access request procedure within the particular period of time when the user mobile device receives the second message of the at least two different messages from the particular device, wherein performing the access request procedure comprises providing, from the user mobile device to the particular device, a set of access request messages comprising access credentials, that are stored in memory of the user mobile device, and the first and second values from a most recent message of the at least two messages that is distributed by the particular device and that is received by the user mobile device.

14. The method of claim 13 further comprising receiving access to the secured resource based on (i) the first value, that is provided during the access request procedure, matching a static identifier uniquely identifying the particular device or the secured resource, and (ii) the second value, that is provided during the access request procedure, matching different second values wirelessly transmitted from the particular device.

15. The method of claim 13 further comprising scanning for the at least two messages over a first wireless network without establishing a connection to the particular device.

16. The method of claim 13, wherein performing the access request procedure comprises (i) identifying a request to access the secured resource based on the first value provided by the user mobile device matching a static identifier uniquely identifying the particular device or the secured resource, (ii) verifying permission to access the secured resource based on the access credentials, and (iii) verifying proximity of the user mobile device to the particular device based on the second value provided by the user mobile device matching a recently distributed second value from the particular device.

* * * * *